US006125927A

United States Patent [19]

Hubert

[11] Patent Number: 6,125,927

[45] Date of Patent: Oct. 3, 2000

[54] HEAT EXCHANGER WITH IMPROVED SUPPLY FOR HEATING, VENTILATION AND/OR AIR CONDITIONING INSTALLATIONS, NOTABLY FOR MOTOR VEHICLES

[75] Inventor: Sylvain Hubert, Reims, France

[73] Assignee: Valeo Thermique Moteur, La Verriere, France

[21] Appl. No.: 08/956,817

[22] Filed: Oct. 23, 1997

[30] Foreign Application Priority Data

Oct. 23, 1996 [FR] France ..... 96 12911

[51] Int. Cl.[7] ..... F28F 9/02

[52] U.S. Cl. ..... 165/173; 165/174; 165/175; 165/176

[58] Field of Search ..... 165/173–176

[56] References Cited

U.S. PATENT DOCUMENTS 5,088,294 2/1992 Ando .
5,186,248 2/1993 Halstead .
5,203,407 4/1993 Nagasaka ..... 165/74
5,228,315 7/1993 Nagasaka et al. ..... 62/509
5,363,910 11/1994 Baba et al. .

FOREIGN PATENT DOCUMENTS 4-353397 12/1992 Japan ..... 165/174

*Primary Examiner*—Allen Flanigan
*Attorney, Agent, or Firm*—Morgan & Finnegan

[57] ABSTRACT

A heat exchanger comprises a bank of tubes mounted between first and second longitudinal headers, the first header being provided with a longitudinal opening, first and second manifolds, and first and second tubes, parallel to the first header, connected respectively to the first and second manifolds, and provided with a longitudinal opening. It also comprises a connection plate having, first and second edges having longitudinal extensions substantially equal to those of the openings and able to be respectively inserted in the latter so as to make the first header integral with the first and second tubes, and two passages to allow the circulation of a fluid between the fist header and each of the tubes.

22 Claims, 2 Drawing Sheets

FIG. 3A
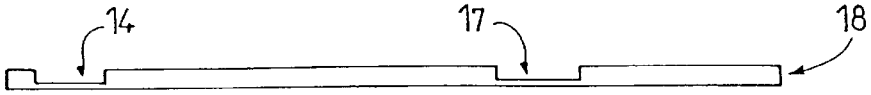
FIG. 3B
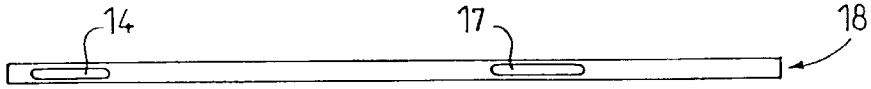
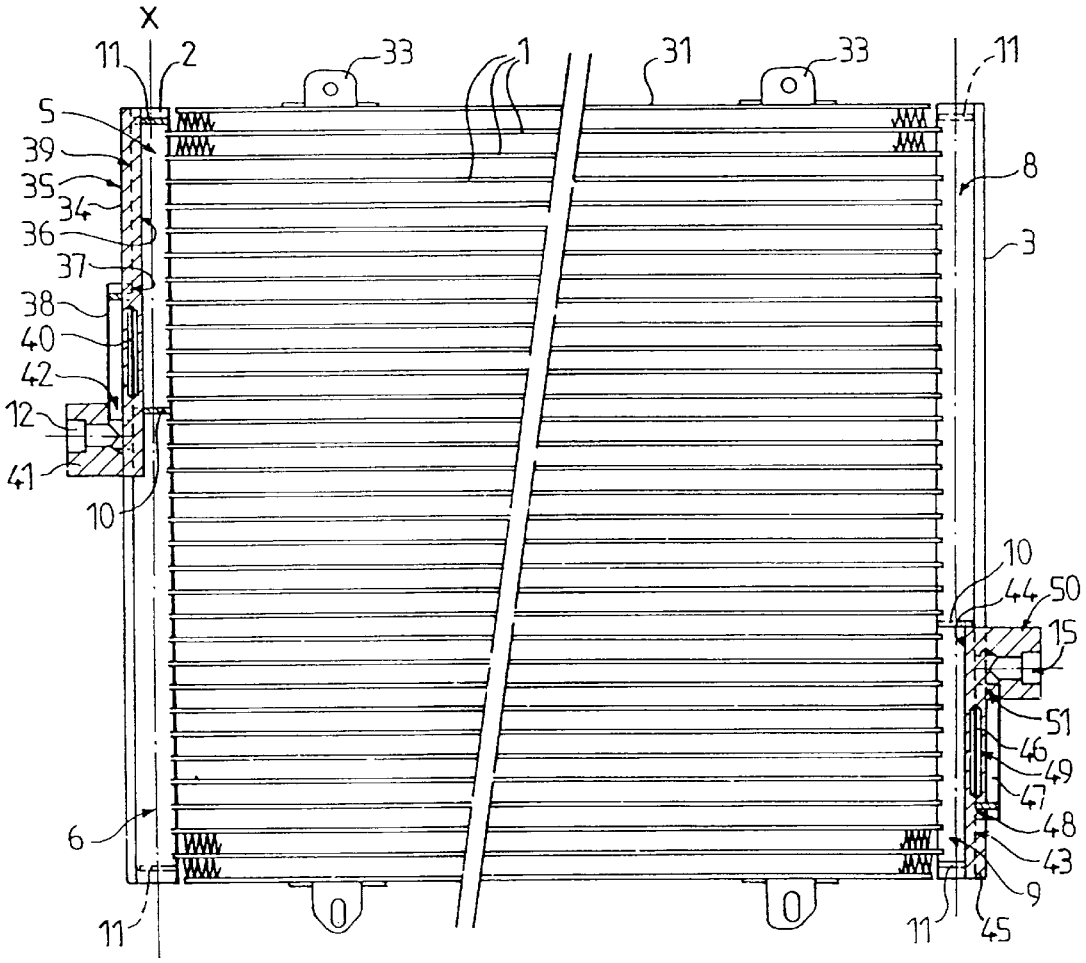
FIG. 4

HEAT EXCHANGER WITH IMPROVED SUPPLY FOR HEATING, VENTILATION AND/OR AIR CONDITIONING INSTALLATIONS, NOTABLY FOR MOTOR VEHICLES

BACKGROUND OF THE INVENTION

The invention concerns the field of heating, ventilation and/or air conditioning installations, notably for motor vehicles.

It concerns more especially brazed heat exchangers which comprise first and second pipes, called inlet and outlet pipes, and a bank of tubes opening out in at least one header. The header generally runs in a longitudinal direction, (preferably substantially vertical).

In some such installations, for example in condensers, the fluid enters the header in an upper part, and leaves in a lower part. The inlet and outlet are connected to the installation, by means of the pipes, to a common connector whose location can vary from one vehicle to another. Such a connection often necessitates complex shapes and little adaptability in the pipes, which makes them bulky and expensive by virtue notably of the bending operations.

Furthermore, in order to afford a good flow of fluid in these pipes, their radius of curvature must be at least equal to their external radius, which makes them bulkier still.

In addition to this there are the mechanical constraints of resistance to vibration, which further increase the complexity of the shapes of the pipes.

In order to overcome certain of these drawbacks, experts have proposed, in the publication DE 43 30 214 A1, to fabricate by extrusion headers with an integrated distribution tube, the latter being connected to the pipe at a given point. Such an embodiment is complex and very expensive, and does not afford true adaptability, which very significantly reduces its interest.

One of the aims of the invention is therefore to provide a heat exchanger which does not exhibit all or some of the drawbacks of the prior art.

SUMMARY OF THE INVENTION

It proposes to this end a heat exchanger of the type described in the introduction, in which, on the one hand, there is provided a first tube independent of the design of the header, substantially parallel thereto, connected to the first pipe, and comprising a first opening which extends longitudinally, and on the other hand the first header is provided with a second opening which also extends longitudinally. It furthermore comprises a first connection plate having, on the one hand, first and second edges having longitudinal extensions substantially equal to those of the first and second openings and designed to be respectively inserted in the latter so as to make the first header integral with the first tube, and on the other hand a passage to allow the circulation of a fluid between the first header and the first tube.

An exchanger is thus produced which is simple to produce, which is inexpensive and which affords great adaptability by virtue of the independence of the manufacture of the tube and header.

Preferably, the first header and the first tube are each produced by bending a metal plate.

It is also preferable, for the second opening to extend over the entire length of the first header, and on the other hand for the first opening to extend over the entire length of the first tube. This simplifies the production of the header and tube, since a simple bending without removal of material (for the openings) is sufficient for their production.

In a preferred embodiment, the exchanger has a second header which extends longitudinally (substantially parallel to the first header), a bank of substantially parallel tubes then being mounted between the first and second headers.

Two variants are envisaged depending on whether the first header is connected to the inlet and outlet pipe, or the first header is connected to the inlet pipe while the second header is connected to the outlet pipe.

In the first variant, there is provided a second tube also independent of the first header, substantially parallel thereto and in line with the first tube, connected to the second pipe, and provided with a third opening extending longitudinally so as to receive the first edge of the first connection plate, which has to this end a longitudinal part whose length is substantially equal to that of the third opening, so as to make the second tube integral with the first header. Furthermore, in order to permit circulation of the fluid between the first header and the second tube, there is provided a second passage in the first connection plate.

In the second variant, there is provided a second tube independent of the second header, substantially parallel thereto, connected to the second pipe, and provided with a third opening extending longitudinally. Furthermore, the second header is provided with a fourth opening which extends longitudinally. Finally, there is provided a second connection plate which has, on the one hand, first and second edges having longitudinal extensions substantially equal to those of the third and fourth openings and designed to be respectively inserted into the latter so as to make the second header integral with the second tube, and on the other hand a second passage to permit the circulation of fluid between the second header and the second tube.

In these two variants, the second tube can be produced by bending a metal plate.

Only in the first variant, the first and second tubes can be produced from the same bent metal plate having a transverse separating partition to prevent any communication between them, which simplifies the production of the exchanger at least in terms of the assembly.

Only in the second variant, it is preferable, firstly, for the second header to be produced preferably by bending a metal plate, secondly, for the third opening to extend over the entire length of the second tube, and thirdly, for the fourth opening to extend over the entire length of the second header. This simplifies the production of the second header and second tube, since only a simple bending without removal of material (for the openings) is sufficient to produce them.

According to another characteristic of the invention, a first connection block is provided in which there is formed by extrusion the first pipe, and which has a first axial housing communicating with the first pipe and allowing the insertion of the first tube. It is also possible to provide a second block in which there is formed by extrusion the second pipe, and having a second axial housing communicating with the second pipe and permitting the insertion of the second tube.

Such an embodiment gives the pipes very good resistance to vibration since they are now made integral, even before brazing, with the header with which they respectively communicate, by virtue of their cooperation with the first and second tubes.

As a variant, when the inlet and outlet are provided on the same header, it is possible to provide a single block formed by extrusion the first and second pipes, and which has first and second axial housings communicating respectively with the first and second pipes and permitting respectively the insertion of the first and second tubes.

BRIEF DESCRIPTION OF THE DRAWINGS

In the description which follows, given by way of example, reference is made to the accompanying drawings, in which:

FIGS. 3A and 3B illustrate the connecting partition between the first header and the first and second tubes of the heat exchanger in FIG. 1, respectively in side and front views; and FIG. 4 illustrates, in a view in transverse section, a second embodiment of a heat exchanger according to the invention.

DETAILED DESCRIPTION OF THE PREFERRED EMBODIMENTS

The invention concerns heat exchangers, notably for motor vehicles.

Hereinafter, by way of non-limitative example, it will be assumed that the heat exchanger is a condenser of a cold loop in a heating and air conditioning installation of a motor vehicle.

Figure 1:
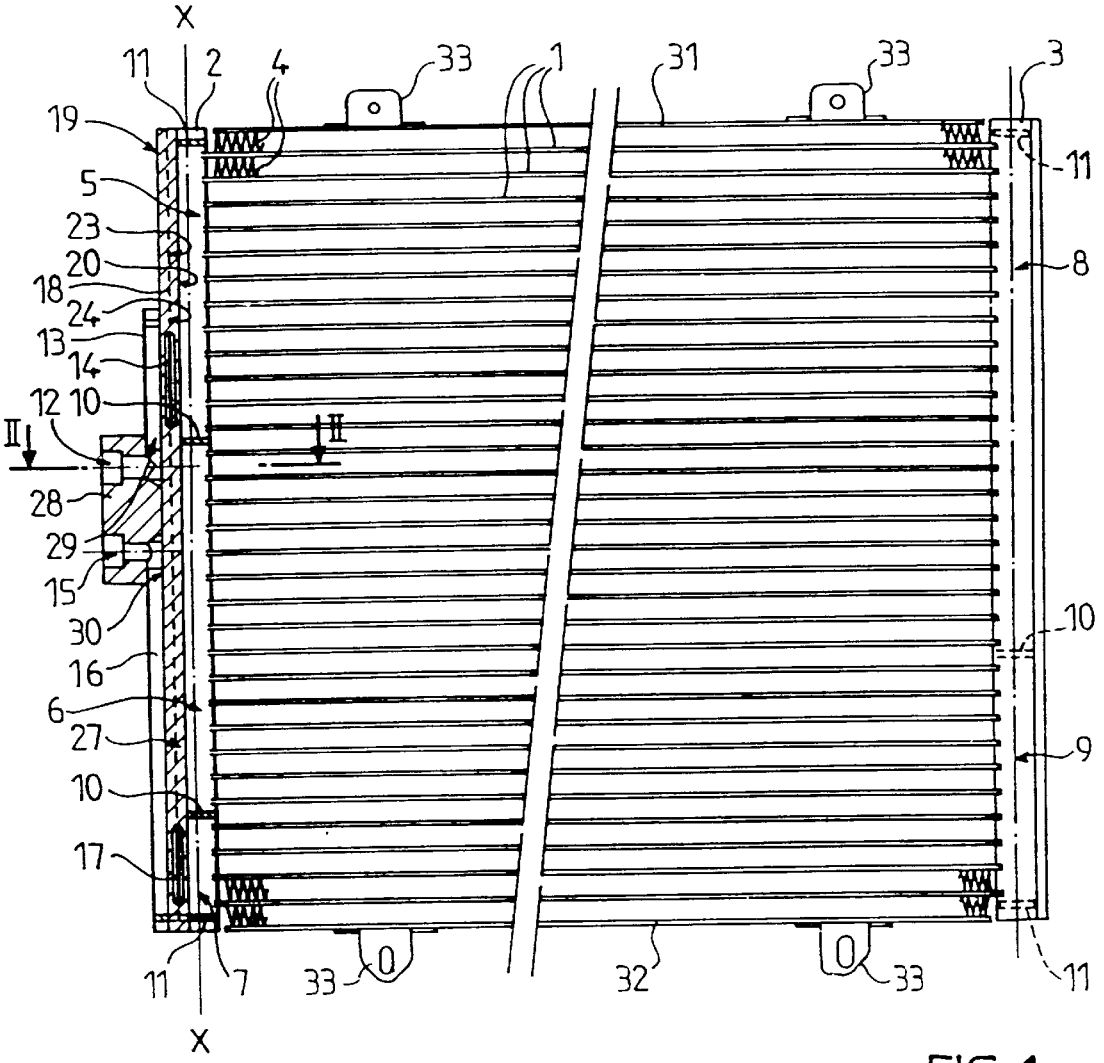
FIG. 1 illustrates, in a transverse section, a first embodiment of a heat exchanger according to the invention.

In FIG. 1, as shown, in transverse section, a condenser of the so-called multi-pass type comprising a bank of parallel tubes 1 mounted between a first header 2 and a second header 3.

The headers 2 and 3 have a longitudinal extension in a direction which, in this example, is vertical (axis X—X). The tubes 1 of the bank are installed in a direction substantially transverse to the axis X—X and are separated from each other by corrugated separators 4 whose purpose is to assist heat exchange between a refrigeration fluid which circulates within the tubes 1 of the bank and air which circulates between these tubes.

Figure 2:
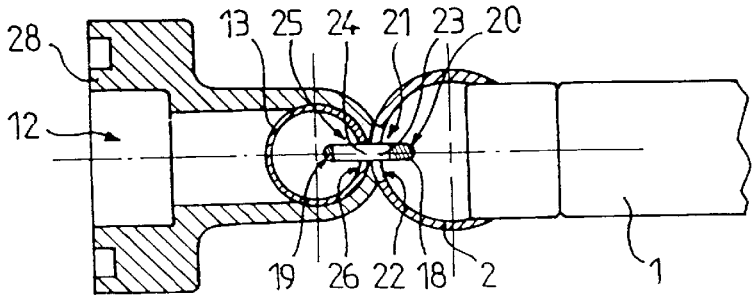
FIG. 2 is a view in cross section along the axis II—II of an enlarged part of the heat exchanger in FIG. 1.

In the example illustrated in FIGS. 1 to 3, the header 2 is subdivided into three sub-chambers 5 to 7, an upstream sub-chamber 5, a downstream sub-chamber 6 and a super-cooling sub-chamber 7.

The second header 3 is subdivided into two sub-chambers 8 and 9, an upstream sub-chamber 8 and a downstream sub-chamber 9.

The various sub-chambers of each header are sealingly separated from each other by partitions 10. Furthermore, the ends of the headers 2 and 3 are blocked by end partitions 11.

In this type of multi-pass condenser, the refrigeration fluid reaches, by means which will be explained hereinafter, the upstream sub-chamber 5 of the first header 2, circulates in the tubes 1 of the bank which open out into this sub-chamber 5, and reaches the upstream sub-chamber 8 of the second header 3, which it leaves through the ends of new tubes 1 whose opposite ends open out in the downstream sub-chamber 6 of the first header 2. When it has reached this downstream sub-chamber 6, the fluid leaves through the ends of tubes 1, then, passing through opposite ends of these tubes, goes into the downstream sub-chamber 9 of the second header 3.

In a conventional condenser, there would be provided in the downstream sub-chamber of the second header 3 an outlet pipe to reinject the cooled condensed fluid into the cold loop of the installation. However, in the example illustrated, there is provided a super-cooling part to further lower the temperature of the fluid condensed. To this end, there are provided other tubes 1 whose first ends open out into the downstream sub-chamber 9 of the second header 3 and second opposite ends opening into the cooling sub-chamber 7 of the first header 2. The fluid which reaches the downstream sub-chamber 9 of the second header 3 can therefore circulate in these tubes 1, and reach the cooling sub-chamber 7, from where it can be evacuated by means which will be described hereinafter in order to return to the cold loop of the installation.

In order to permit the insertion in the first header 2 of the refrigeration fluid to be cooled and condensed, there is provided an inlet pipe 12 which communicates with a first supply tube 13 installed in a position substantially parallel to the first header 2, and communicating with the latter by means of a first passage 14 forming a slot (see FIGS. 3A and 3B), produced in a connection plate 18 which will be further described later. This first slot 14 has a longitudinal extension adapted to the shape, and consequently to the performance, of the upstream sub-chamber 5 of the first header 2.

Similarly, in order to permit the discharge of the super-cooled refrigeration fluid from the cooling sub-chamber 7 of the first header 2, there is provided an outlet pipe 15 connected to a second discharge tube 16 which extends also substantially parallel to the first header 2 and communicating through a bottom part with the cooling sub-chamber 7 of the first header 2, by means of a second passage 17 forming a second slot produced in the intermediate plate 18 (see FIGS. 3A and 3B). This second slot 17 has a longitudinal extension adapted to the shape of the cooling sub-chamber 7.

The first supply tube 13 and the second discharge tube 16 are fixed to the first header 2 by means of the connection partition 18, which has a first longitudinal edge 19 and a second longitudinal edge 20 designed to be inserted respectively in openings 24, 23, 27 produced in the walls defining the first 13 and second 16 tubes, as well as the first header 2.

Preferably, the first header 2 is produced by bending a metal plate, so as to define a cylinder, with generating lines parallel to the axis X—X, at least partially open at its two longitudinal edges 21 and 22 so as to define the opening 23 designed to receive the second edge 20 of the connection plate 18. Preferably, the opening 23 of the first header 2 extends over the entire length (or height) of the wall which defines it. Thus, in order to obtain the opening 23, it is not necessary to cut at the longitudinal edges 21 and 22 of the wall which defines the first header 2. The opening 23 is directly formed by the gap which separates the two longitudinal edges 21 and 22. Such an embodiment obviously requires the second longitudinal edge 20 of the connection plate 18 to have a longitudinal extension substantially equal to that of the opening 23 of the first header 2.

Of course, if the opening 23 produced in the first header 2 did not have a longitudinal extension equal to the length (or height) of this header 2, it would not be necessary for the second edge 20 of the connection partition 18 to extend over the entire height of the header, but simply over the height corresponding to the longitudinal extension of the opening 23.

The supply 13 and discharge 16 tubes are produced substantially in the same fashion as the first header 2, from metal plates bent to define a cylinder, with generating lines substantially parallel to the axis X—X, and with a chosen longitudinal extension.

In the example illustrated in FIG. 1, the first supply tube 13 and second discharge tube 16 are produced from two separate elements, but it is clear that it might be envisaged to produce them from a single metal plate provided at a given point with a separating partition to enable these two tubes to be separated sealingly.

The first supply tube 13 comprises a longitudinal opening 24 defined by the longitudinal edges 25 and 26 of the wall which forms it, which edges are placed apart to this end. In the example illustrated, the opening 24 extends over the entire height (or length) of the first supply tube 13. The first longitudinal edge 19 of the connection partition 18 can thus be inserted in the opening 24. This first supply tube 13 is positioned in such a way that the first slot 14 produced in the connection plate 18 is housed partially within the space defined by its wall. Consequently, the fluid, which comes through the inlet pipe 12, reaches the supply tube 13, passes through the first slot 14 of the connection plate 18, and flows into the upstream sub-chamber 5 of the first header 2.

The second discharge tube 16 is produced substantially in the same fashion as the first supply tube 13. It is therefore formed from a metal plate bent into a cylinder, with generating lines substantially parallel to the axis X—X, and whose longitudinal edges are slightly separated so as to define an opening 27 designed to receive the first edge 19 of the connection plate 18. In the example illustrated, the opening 27 extends over the entire height of the second discharge tube 16, and consequently the first edge 19 of the connection plate 18 extends over the entire height of the wall defining this second discharge tube 16.

Of course, as in the case of the first header 2, it is possible to provide a first and/or second tube in which the longitudinal opening does not extend over the entire length of the tube or tubes. In this case, the opening must be produced by cutting out from the wall which defines the tube to which it belongs and, consequently, the first edge 19 of the connection plate 18 must be arranged accordingly.

In the example illustrated in FIG. 1, by way of non-limitative example, the inlet pipe 12 and the outlet pipe 15 are produced by extrusion, in a metal connection block 28 designed to be connected directly to a complementary connector of the cold loop of the installation.

The connection block 28 comprises a first longitudinal recess 29 which communicates with the inlet pipe 12 and is designed to receive the open end of the first supply tube 13, so as to permit the circulation of fluid from the inlet pipe 12 to the said supply tube 13. This connection block 28 comprises a second axial recess 30 which communicates with the outlet pipe 15 and is designed to receive the open end of the second discharge tube 16, so as to permit the circulation of fluid from this discharge tube 16 to the outlet manifold 15.

Of course, it would be possible to provide a first connection block for the first supply tube 13, and a second connection block, totally independent of the first connection block, for the second discharge tube 16. Likewise, it is possible to provide only one connection block 28 provided with an axial recess over the whole of its length so as to permit the insertion of a wall defining both the first supply tube 13 and the second discharge tube 16.

In such a heat exchanger, the connection block or blocks can be positioned at any point situated at least between the two ends of the first header 2. To do this it is necessary to change the respective lengths of the tubes 13 and 16.

The connection block or blocks which now include the inlet and outlet pipe exhibit good resistance to vibration because they are integral with the first header 2 through the connection plate 18 and the supply 13 and discharge 16 tubes.

Such an assembly affords great adaptability.

Preferably, the connection plate 18 is a metal plate in the thickness of which there are produced the first 14 and second 17 slots, as illustrated in FIGS. 3A and 3B.

The second header 3 can be produced in any fashion known to experts. It can be produced by bending a metal plate, or by extrusion.

Furthermore, in order to protect the tubes 1 of the bank, there are provided, on each side of the two tubes positioned at the ends of the bank, protective cheeks 31 and 32 provided with fixing lugs 33 to permit the fixing of the heat exchanger on the chassis of the vehicle, or at any other point provided to this end.

Preferably, the materials forming such an exchanger, and notably the first and second tubes, the headers, the tubes of the bank and the connection blocks, are produced from aluminum. These various constituents are made permanently integral with each other by passing through a furnace, for example a brazing or welding furnace.

Reference will now be made to FIG. 4 to describe a second embodiment of the invention. In fact, this second embodiment is not unlike the one described previously. The main difference lies in the fact that the first header 2 communicates only with the inlet pipe 12, while the second header 3 communicates with the outlet pipe 15. Furthermore, in the example illustrated, no super-cooling part is provided for the refrigeration fluid. Consequently there is no cooling sub-chamber in the first header 2. Nonetheless, it is perfectly conceivable, as in the embodiment previously described, to provide such a super-cooling part.

In this variant embodiment, the first header and the second header are both produced from a metal plate bent so as to define a cylinder with generating lines parallel to the axis X—X.

In the example illustrated in FIG. 4, a first connection plate 34 is therefore provided whose first 35 and second 36 longitudinal edges are designed to be inserted respectively in an opening 37 in the first tube 38 and in an opening 39 in the first header 2.

The first connection plate 34 now has only a first passage 40 forming a first slot. This first slot is produced in the same fashion as the connection plate marked 18 in the previous embodiment (see FIGS. 3A and 3B).

In this example, the first connection plate 34 extends over only a part of the height (or length) of the first header 2. Consequently, the opening 39 of the first header 2 extends only over part of the total height thereof, and more specifically over a height equal to the longitudinal extension of the second edge 36 of the first partition 34. This opening 39 is for example produced by local cutting of the longitudinal edges of the wall which defines the first header 2.

As in the embodiment previously described, there is provided a first metal connection block 41 in which the inlet pipe 12 is produced by extrusion, and which comprises an axial recess 42 communicating with the inlet pipe 12 and permitting the insertion of the open end of the first supply tube 38.

The second header 3 is virtually identical to the first header 2 which has just been described. Its design is consequently identical to that which has just been described.

This second header 3 consequently comprises a longitudinal opening 43 which extends only over a part of its height and is designed to receive a second longitudinal edge 44 of a second connection plate 45.

This second connection plate 45 comprises a second passage 46 forming a second slot 47 affording communication between the downstream sub-chamber 9 of the second header 3 and a second discharge tube 47 which communicates with the outlet pipe 15.

The second discharge tube 47 is produced in the same fashion as the first supply tube 38, namely from a metal plate bent into a cylinder with generating lines substantially parallel to the axis X—X. It also comprises a longitudinal opening 48 designed to receive the first edge 49 of the second connection plate 45. In this example, the longitudinal extension of the opening 48 is equal to the height (or length) of the wall which defines the second discharge tube 47.

The outlet pipe 15 is, like the inlet pipe 12, produced by extrusion in a second connection block 50 which also comprises an axial recess 51, which communicates with the outlet pipe 15 and allowing the insertion of the open end of the second discharge tube 47.

Of course, in this embodiment, it would be possible to provide first 34 and second 45 connection plates with a longitudinal extension substantially equal to that of the headers 2 and 3. In this case, it is clear that the opening produced in each of the headers should extend over the entire height of the boxes.

The invention is not limited to the embodiment described above, but includes all variants which experts may develop within the scope of the following claims.

A condenser has been described which comprises two headers, but it is clear that the invention applies equally to heat exchangers equipped with a single header.

What is claimed is:

1. A heat exchanger comprising:

a bank of tubes opening into a first header extending in a longitudinal direction;

a first and a second pipe;

a first tube substantially parallel to, and adjacent to, the first header, connected to the first pipe and having a first opening which extends in said longitudinal direction, wherein the first header including a second opening which extends in said longitudinal direction; and a first connection plate joining the header and tube, the connection plate having first and second edges having longitudinal extensions substantially equal to those of the first and second openings, the first and second edges being received in the corresponding openings of the header and tube, and a first passage to allow the circulation of a fluid between the first header and the first tube.

2. A heat exchanger according to claim 1, wherein the first header and the first tube are each produced by bending a metal plate.

3. A heat exchanger according to claim 1, wherein the second opening extends over the entire length of the first header.

4. A heat exchanger according to claim 1, wherein the first opening extends over the entire length of the first tube.

5. A heat exchanger according to claim 1, wherein it has a second header extending in a longitudinal direction, the said bank being mounted between the first and second headers.

6. A heat exchanger according to claim 1, further comprising a second tube substantially parallel to the first header, connected to the second pipe, and having a third opening extending in said longitudinal direction to receive the first edge of the first connection plate, wherein the first connection plate has a longitudinal part whose length is substantially equal to that of the third opening and a second passage to permit the circulation of fluid between the first header and the second tube.

7. A heat exchanger according to claim 5 comprising a second tube substantially parallel to the second header, connected to the second manifold, and provided with a third opening extending in the said longitudinal direction, wherein the second header is provided with a fourth opening extending in the said longitudinal direction, and a second connection plate which has, first and second edges having longitudinal extensions substantially equal to those of the third and fourth openings and designed to be respectively inserted into the latter so as to make the second header integral with the second tube, and a second passage to permit the circulation of fluid between the said second header and the said second tube.

8. A heat exchanger according to claim 6, wherein the second tube is produced by bending a metal plate.

9. A heat according to claim 6, wherein the first and second tubes are produced from a single bent metal plate having a transverse separating partition to prevent any communication between the said first and second tubes.

10. A heat exchanger according to claim 6, wherein the first opening extends over the entire length of the second tube.

11. A heat according to claim 7, wherein the fourth opening extends over the entire length of the second header.

12. A heat exchanger according to claim 1, further comprising a first connection block in which the first pipe is formed by extrusion, said first connection block having a first axial housing communicating with the first pipe and permitting an insertion of the first tube.

13. A heat exchanger according to claim 6, further comprising a second connection block in which the second pipe is formed by extrusion, said second connection block having a second axial housing communicating with the second pipe and permitting an insertion of the second tube.

14. A heat exchanger according to claim 6 further comprising a connection block containing the first and second pipe, and a first and a second axial housing communicating respectively with the first and second pipe and permitting respectively an insertion of the first and second tubes.

15. A heat exchanger according to claim 7, wherein the second header is produced by folding a metal plate.

16. A heat exchanger comprising:

a first and a second header;

a bank of substantially parallel tubes mounted between the first and the second header;

a first supply tube and a second discharge tube, wherein the first supply tube and the second discharge tube are extending in a longitudinal direction and are substantially parallel to, and adjacent to, the first header;

an inlet and an outlet pipe, wherein the inlet manifold is connected with the first supply tube and the outlet pipe is connected with the second discharge tube; and a first connection plate joining the header and tube, the connection plate having first and second edges having longitudinal extensions substantially equal to those of the first and second openings, the first and second edges being received in the corresponding openings of the header and tube, and a first passage to allow the circulation of a fluid between the first header and the first tube.

17. A heat exchanger according to claim 16, wherein the first and the second header each comprises an upstream sub-chamber and a downstream sub-chamber.

18. A heat exchanger according to claim 17, wherein the first header further comprises a super cooling sub-chamber.

19. A heat exchanger comprising:

a first header;

a bank of substantially parallel tubes, adjacent to the first header, opening into the first header and extending in a longitudinal direction;

a first tube substantially parallel to the first header and connected to a first pipe and having a first opening which extends in said longitudinal direction, wherein the first header including a second opening which extends in said longitudinal direction;

a first connection plate joining the header and tube, the connection plate comprising first and second edges having longitudinal extensions substantially equal to those of the first and second openings, the first and second edges being received in the corresponding openings of the header and tube, and a first passage to allow the circulation of a fluid between the first header and the first tube;

a second header which extends in said longitudinal direction and is substantially parallel to the first header;

a second tube substantially parallel to the first header, connected to a second pipe, and having a third opening extending in said longitudinal direction to receive the first edge of the first connection plate;

a first connection block which comprises a first axial housing communicating with the first pipe and permitting an insertion of the first tube; and a second connection block which comprises a second axial housing communicating with the second pipe and permitting an insertion of the second tube.

20. A heat exchanger comprising:

a bank of tubes opening into a first header extending in a longitudinal direction;

a first and a second pipe;

a first tube substantially parallel to the first header, connected to the first pipe and having a first opening which extends in said longitudinal direction, wherein the first header including a second opening which extends in said longitudinal direction a first connection plate joining the header and tubes, the connection plate having first and second edges having longitudinal extensions substantially equal to those of the first and second openings and a first passage to allow the circulation of a fluid between the first header and the first tube; and a first connection block in which the first pipe is formed by extrusion, said first connection block having a first axial housing communicating with the first pipe and permitting an insertion of the first tube.

21. A heat exchanger according to claim 20, further comprising:

a second tube substantially parallel to the first header, connected to the second pipe, and having a third opening extending in said longitudinal direction to receive the first edge of the first connection plate, wherein the first connection plate has a longitudinal part whose length is substantially equal to that of the third opening, and a second passage to permit the circulation of fluid between the first header and the second tube;

a second connection block in which the second pipe is formed by extrusion, said second connection block having a second axial housing communicating with the second pipe and permitting an insertion of the second tube.

22. A heat exchanger comprising:

a bank of tubes opening into a first header extending in a longitudinal direction;

a first and a second pipe;

a first tube substantially parallel to the first header, connected to the first pipe and having a first opening which extends in said longitudinal direction, wherein the first header including a second opening which extends in said longitudinal direction;

a second tube substantially parallel to the first header, connected to the second pipe, and having a third opening extending in said longitudinal direction to receive the first edge of the first connection plate, wherein the first connection plate has a longitudinal part whose length is substantially equal to that of the third opening, and a second passage to permit the circulation of fluid between the first header and the second tube;

a first connection plate joining the header and tubes, the connection plate having first and second edges having longitudinal extensions substantially equal to those of the first and second openings and a first passage to allow the circulation of a fluid between the first header and the first tube;

a first connection block in which the first pipe is formed by extrusion, said first connection block having a first axial housing communicating with the first pipe and permitting an insertion of the first tube; and a connection block containing the first and second pipe, and a first and a second axial housing communicating respectively with the first and second pipe and permitting respectively an insertion of the first and second tubes.

* * * * *